US008055010B2

(12) United States Patent
Lemarquand et al.

(10) Patent No.: US 8,055,010 B2
(45) Date of Patent: Nov. 8, 2011

(54) MAGNETIC STRUCTURE FOR AN IRONLESS ELECTRODYNAMIC-LOUDSPEAKER MOTOR, MOTORS AND LOUDSPEAKERS

(75) Inventors: Guy Lemarquand, Le Mans (FR); Benoît Merit, Moutiers les Mauxfaits (FR)

(73) Assignees: Orkidia Audio, Saint-Jean-de-Luz (FR); Universite du Maine, Le Mans (FR)

( * ) Notice: Subject to any disclaimer, the term of this patent is extended or adjusted under 35 U.S.C. 154(b) by 530 days.

(21) Appl. No.: 12/300,883

(22) PCT Filed: Sep. 18, 2008

(86) PCT No.: PCT/FR2008/051678

§ 371 (c)(1),
(2), (4) Date: Nov. 14, 2008

(87) PCT Pub. No.: WO2009/047455

PCT Pub. Date: Apr. 16, 2009

(65) Prior Publication Data

US 2010/0172534 A1 Jul. 8, 2010

(30) Foreign Application Priority Data

Sep. 18, 2007 (FR) ..... 07 57657

(51) Int. Cl.
*H04R 9/06* (2006.01)

(52) U.S. Cl. ..... 381/400; 381/412; 381/421

(58) Field of Classification Search ..... 381/398, 381/400, 412, 421

See application file for complete search history.

(56) References Cited

U.S. PATENT DOCUMENTS

| | | | | |
|---|---|---|---|---|
| 5,142,260 | A * | 8/1992 | House | 335/222 |
| 5,715,324 | A * | 2/1998 | Tanabe et al. | 381/412 |
| 5,815,587 | A * | 9/1998 | Goller | 381/412 |
| 6,151,402 | A * | 11/2000 | Azima et al. | 381/396 |
| 6,847,726 | B2 * | 1/2005 | Button et al. | 381/401 |
| 6,917,690 | B2 * | 7/2005 | Stiles | 381/412 |
| 7,263,199 | B2 * | 8/2007 | Trandafir | 381/409 |
| 2006/0182303 | A1 | 8/2006 | Trandafir | |
| 2009/0028375 | A1 * | 1/2009 | Richoux et al. | 381/412 |

FOREIGN PATENT DOCUMENTS

| | | |
|---|---|---|
| EP | 1 553 802 | 7/2005 |
| JP | 62-173968 | 7/1987 |
| JP | 10-23591 | 1/1998 |

* cited by examiner

*Primary Examiner* — Savitr Mulpuri
(74) *Attorney, Agent, or Firm* — Young & Thompson

(57) ABSTRACT

A magnetic structure generating a magnetic field for an ironless motor of an electrodynamic loudspeaker having a mobile coil, wherein the magnetic structure generates a magnetic field in a gap in which the coil is arranged. The magnetic structure includes of a stack of three magnets corresponding to one intermediate magnet and two top and bottom covering magnets, the magnets forming a straight gap border and being located side by side, the intermediate magnet having a radial magnetic polarization, the covering magnets having identical magnetic polarizations and remanent magnetizations. The covering magnets have a radial or axial magnetic polarization. When magnetic polarization of the covering magnets is radial, remanent magnetization of each covering magnet is higher than remanent magnetization of the intermediate magnet, and when magnetic polarization of the covering magnets is axial, remanent magnetization of each covering magnet is lower than remanent magnetization of the intermediate magnet. Motors are provided.

19 Claims, 4 Drawing Sheets

MAGNETIC STRUCTURE FOR AN IRONLESS ELECTRODYNAMIC-LOUDSPEAKER MOTOR, MOTORS AND LOUDSPEAKERS

FIELD OF THE INVENTION

The present invention relates to a magnetic structure for an ironless electrodynamic-loudspeaker motor, motors comprising such a structure, as well as loudspeakers. It has applications in the industrial field of sound reproduction and public address systems, notably for premises.

BACKGROUND OF THE INVENTION

Electrodynamic loudspeakers usually comprise a cylindrical coil mechanically integral with an emissive acoustic surface also called diaphragm. The coil is generally borne by a straight mandrel integral with the diaphragm. This emissive acoustic surface is usually conical (cone) or spherical (dome) in shape. Loudspeakers generally have an axis of cylindrical symmetry, although elliptical loudspeakers exist. They also comprise a fixed magnetic circuit the function of which is to produce a radial magnetic field onto the coil, inside a gap.

To obtain a quality sound reproduction, it is desirable for the magnetic induction to be the most constant possible along a generating line of the gap, the one on which the coil is located and moves. Indeed, variations of this induction induce sound distortions when the coil moves.

Iron magnetic circuits according to the state of the art generally comprise an axially-magnetized annular or discoidal magnet and ferromagnetic parts intended for channelling magnetic flux through the coil. For example, patent application WO 96/04706, "Axially focused radial magnet voice coil actuator", M. STRUGACH, proposes using radial magnets. Further, the proposed magnetic circuit comprises iron or soft ferromagnetic material.

Defects induced by the presence of iron in the magnetic circuit are now well known. Consequently, for a few years, ironless magnetic circuit structures have been proposed. For example, patent EP-0 503 860, "Transducer motor assembly", W. HOUSE, does not explicitly mention the presence of iron and proposes using two axial magnets in mutual repulsion. The latter structure has been improved using a radial magnet between two axial magnets in patent EP-1 553 802, "Magnetic circuit and speaker", OHASHI. In the latter document, the loudspeaker motor comprises a stack of three magnets having the same remanent magnetisation and alternate magnetic field polarizations, at 90° relative to each other, and the magnetic polarization orientations of which are such that the magnetic field loopback outside the magnets is done essentially on the gap side, as shown in FIG. 4 of this document.

Finally, magnetic circuits using triangular-section magnets have been proposed in patent application FR-05/53331, "Transducteur électrodynamique, applications aux haut-parleurs et géophones", G. LEMARQUAND, V. LEMARQUAND and B. RICHOUX. If the latter magnetic circuits are efficient, they however need a costly machining of the magnets.

SUMMARY OF THE INVENTION

Thus, it is desirable to develop an ironless electrodynamic motor that is highly efficient, in particular thanks to a good regularity of the magnetic field in the gap, and relatively simple and inexpensive to make. It is one of the goals of the invention, which implements one or more radial internal-magnetic-field permanent magnets.

Therefore, the invention relates to a magnetic structure generating a magnetic field for an ironless motor of an electrodynamic loudspeaker having a mobile coil, wherein the magnetic structure generates a magnetic field in a gap in which the coil is arranged, said magnetic structure consisting of a stack of three magnets corresponding to one intermediate magnet and two top and bottom covering magnets, the gap-circumscribing edges of said magnets being aligned and forming a straight gap border, said magnets being further located side by side, the intermediate magnet having a radial magnetic polarization, the covering magnets having the same magnetic polarization and substantially identical remanent magnetizations.

According to the invention, the covering magnets have a radial or axial magnetic polarization and, when magnetic polarization of the covering magnets is radial, remanent magnetization of each covering magnet is higher than remanent magnetization of the intermediate magnet, and when magnetic polarization of the covering magnets is axial, remanent magnetization of each covering magnet is lower than remanent magnetization of the intermediate magnet.

In the context of the invention, the term "magnet" covers both a single magnet (pellet, ring/crown) and an assembly of magnets (notably tiles), as will be explained hereinafter.

In various embodiments of the invention, following means are used, which can be used alone or in any technically possible combination:

remanent magnetization of each covering magnet is higher or lower, according to the case, by 1% of remanent magnetization of the intermediate magnet, and preferably by 5%, remanent magnetization of each covering magnet is higher or lower, according to the case, by 10% of remanent magnetization of the intermediate magnet, in a magnetic structure, the covering magnets are also mutually identical in size, in a magnetic structure, the covering magnets are also mutually identical in volume, in a magnetic structure, the covering magnets are also mutually identical in shape, in a magnetic structure, the covering magnet widths are the same, in a magnetic structure, the width of each covering magnet is smaller than the width of the intermediate magnet, in a magnetic structure, the width of each covering magnet is equal to the width of the intermediate magnet, in a magnetic structure, the width of each covering magnet is larger than the width of the intermediate magnet, the gap-side edges of each of the three magnets are located on a same vertical generating line (the gap-lining edges of each of the three magnets being aligned), the three magnets have the same magnetic polarization, the polarization being radial (horizontal), the same-sign pole faces of the three magnets lining the gap, remanent magnetization of each covering magnet being higher than remanent magnetization of the intermediate magnet, the intermediate magnet has a radial (horizontal) magnetic polarization and the two covering magnets have a magnetic polarization that is coaxial (vertical, because parallel) to the axis of symmetry of the loudspeaker, signs of the covering magnet pole faces in contact with the intermediate magnet being mutually identical and the same as the sign of the gap-lining pole face of the intermediate magnet, remanent magnetization of each covering magnet being lower than remanent magnetization of the intermediate magnet, at least one of the radial-magnetic-polarization magnets consists of an assembly of elementary magnets (or tiles) juxtaposed along a circumference (or another suitable shape) to form a ring or a crown, the magnets with a magnetic polarization coaxial to the axis of symmetry of the loudspeaker are crown-block magnets ("block" because they are monolithic/single-piece), the magnets with a magnetic polarization coaxial to the axis of symmetry of the loudspeaker are pellet-block magnets ("block" because they are monolithic/single-piece), the magnetic structure is internal, the magnetic structure is external, the magnetic structure has a cylindrical symmetry, size and magnetizations of the internal magnetic structure are independent of those of the external magnetic structure (indeed, more generally, apart from the cylindrical symmetry case, the internal structure creates its proper uniform field with its proper size and the external structure creates its proper uniform field with its proper size, and the total field is the sum of the both and is also uniform; generally, the possible defects of a structure can be compensated by the other structure), the loudspeaker is circular, elliptical or even square or substantially square in shape.

The invention also relates to a motor for an electrodynamic loudspeaker, comprising a single magnetic structure according to one or more of the described characteristics, wherein said magnetic structure can be internal (toward the centre of the motor) or external relative to the coil.

The invention also relates to a motor for an electrodynamic loudspeaker, comprising, opposite to each other and at the same level (height), two magnetic structures internal and external relative to the coil, each of the structures being according to one or more of the described characteristics, magnetic polarizations of similar magnets (top internal covering versus top external covering or internal intermediate versus external intermediate or bottom internal covering versus bottom external covering) being identical in both magnetic structures. In a variant, the magnetic structures are geometrically and rotationally symmetric relative to the coil. In another variant, they are not or only partially.

Finally, the invention relates to a loudspeaker comprising a motor according to one or more of the described characteristics.

Therefore, one of the objects of the invention is to obtain in the gap, along the coil-bearing generating line, an induction (magnetic field) substantially constant and preferably over a height corresponding at least substantially to the intermediate magnet height. Induction is considered to be substantially constant when it does not vary by more than 1% and preferably, even better, when it does not vary by more than 0.5% over the considered height.

BRIEF DESCRIPTION OF DRAWINGS

The present invention will now be exemplified by the following description of embodiments, without being limited thereto, and in relation with.

DETAILED DESCRIPTION OF INVENTION

Figure 1:
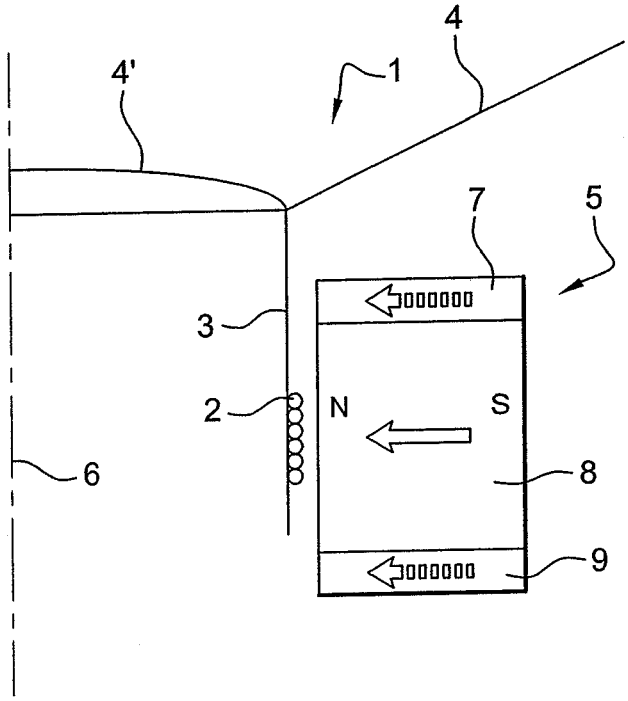
FIG. 1 which is a schematic vertical-sectioned view of a mobile-coil loudspeaker, the section passing through the vertical fore-and-aft axis of cylindrical symmetry of said loudspeaker and showing a first type of electrodynamic motor having an external magnetic structure and the same radial magnetic polarization of magnets, FIG. 2 which is a schematic vertical-sectioned view of a mobile-coil loudspeaker, the section passing through the vertical fore-and-aft axis of cylindrical symmetry of said loudspeaker and showing a second type of electrodynamic motor having an external magnetic structure and the same radial magnetic polarization of magnets, FIG. 3 which is a schematic vertical-sectioned view of a mobile-coil loudspeaker, the section passing through the vertical fore-and-aft axis of cylindrical symmetry of said loudspeaker and showing a third type of electrodynamic motor having an external magnetic structure and the same radial magnetic polarization of magnets, FIG. 4 which is a schematic vertical-sectioned view of a mobile-coil loudspeaker, the section passing through the vertical fore-and-aft axis of cylindrical symmetry of said loudspeaker and showing a fourth type of electrodynamic motor having an external magnetic structure and crossed magnetic polarizations of magnets, FIG. 5 which is a schematic vertical-sectioned view of a mobile-coil loudspeaker, the section passing through the vertical fore-and-aft axis of cylindrical symmetry of said loudspeaker and showing a fifth type of electrodynamic motor having external and internal magnetic structures, with the same radial magnetic polarization of magnets and a rotational symmetry in magnetization and size between the internal and external structures, FIG. 6 which is a schematic vertical-sectioned view of a mobile-coil loudspeaker, the section passing through the vertical fore-and-aft axis of cylindrical symmetry of said loudspeaker and showing a sixth type of electrodynamic motor with external and internal magnetic structures having on the whole the same types of radial magnetic polarization of magnets but without a perfect rotational symmetry in magnetization and size between the internal and external structures, and FIG. 7 which is a schematic vertical-sectioned view of a mobile-coil loudspeaker, the section passing through the vertical fore-and-aft axis of cylindrical symmetry of said loudspeaker and showing a seventh type of electrodynamic motor with external and internal magnetic structures each having crossed radial magnetic polarizations of magnets but without a perfect rotational symmetry in size between the internal and external structures.

Loudspeaker 1 in FIG. 1 comprises a coil 2 borne by a mandrel 3 integral with a diaphragm 4 and 4' not described in detail herein and which are mobile elements of the loudspeaker. The coil is immersed in a static magnetic field in a gap (the term "gap" is used in a generic way, even if there is no iron for the magnetic field to loop back outside the gap in the motor according to the invention, which is ironless). Magnetic field of the gap is created by a fixed magnetic structure 5 generating said magnetic field and which is external in the present case. So, according to the current passing through the coil, a force is generated which causes movements called excursions of the coil, the mandrel and the diaphragm. It is to be noticed that the other elements of the loudspeaker, such as for example the frame or the mechanical suspension(s) (notably, the "spider") are not shown for reasons of simplification.

In this example, the magnetic structure is external because toward the outside of mandrel 3 that bears coil 2 (the axis 6 of cylindrical symmetry of loudspeaker 1 is considered as being central and is toward the inside relative to the mandrel/coil assembly). The magnetic structure comprises a stack of three magnets, one intermediate magnet 8 and two top 7 and bottom 9 covering magnets, having the same radial magnetic polarization (horizontal in FIG. 1): signs of the gap-side pole faces are identical (either north or south). Widths (horizontal measure in FIG. 1) of all these magnets are identical. The gap-side pole faces (herein of the same sign) of these three magnets are in continuity with each others on the same vertical straight line substantially parallel to the generating line of mandrel 3 and to axis of symmetry 6 of the loudspeaker. At rest, coil 2 is in the median part (in the direction of the height and thus of the excursion) of the gap. During excursions, the coil moves inside this gap.

In this configuration of three-magnets having identical radial magnetic polarizations, intermediate magnet 8 has a remanent magnetization lower that than of each of the two covering magnets 5 and 9. Top (upper) 5 and bottom (lower) covering magnets sandwich intermediate magnet 8, all those magnets being located side by side.

So, loudspeaker of FIG. 1 implements two radial-magnetic-polarization rings (covering magnets 7 and 9), one above and the other below the radial-magnetic-polarization intermediate magnet 8. Magnets forming these two rings 7 and 9 have a remanent magnetization higher than remanent magnetization of intermediate magnet 8. As a result and thanks to size-optimization of top (upper) 7 and bottom (lower) 9 rings, a constant induction is obtained in the gap over a significant height corresponding at least substantially to the height of the intermediate magnet.

It is to be noticed that, in the context of the invention, the term "magnet" covers both a single magnet and a magnet consisting of an assembly of several elementary magnets. This latter case is essentially considered for magnets having a radial magnetic polarization (horizontal in the figure) and for which assemblies of elementary magnets (also called tiles) juxtaposed over a circumference (or an ellipse or another shape according to the type of loudspeaker) can be implemented.

Figure 5:
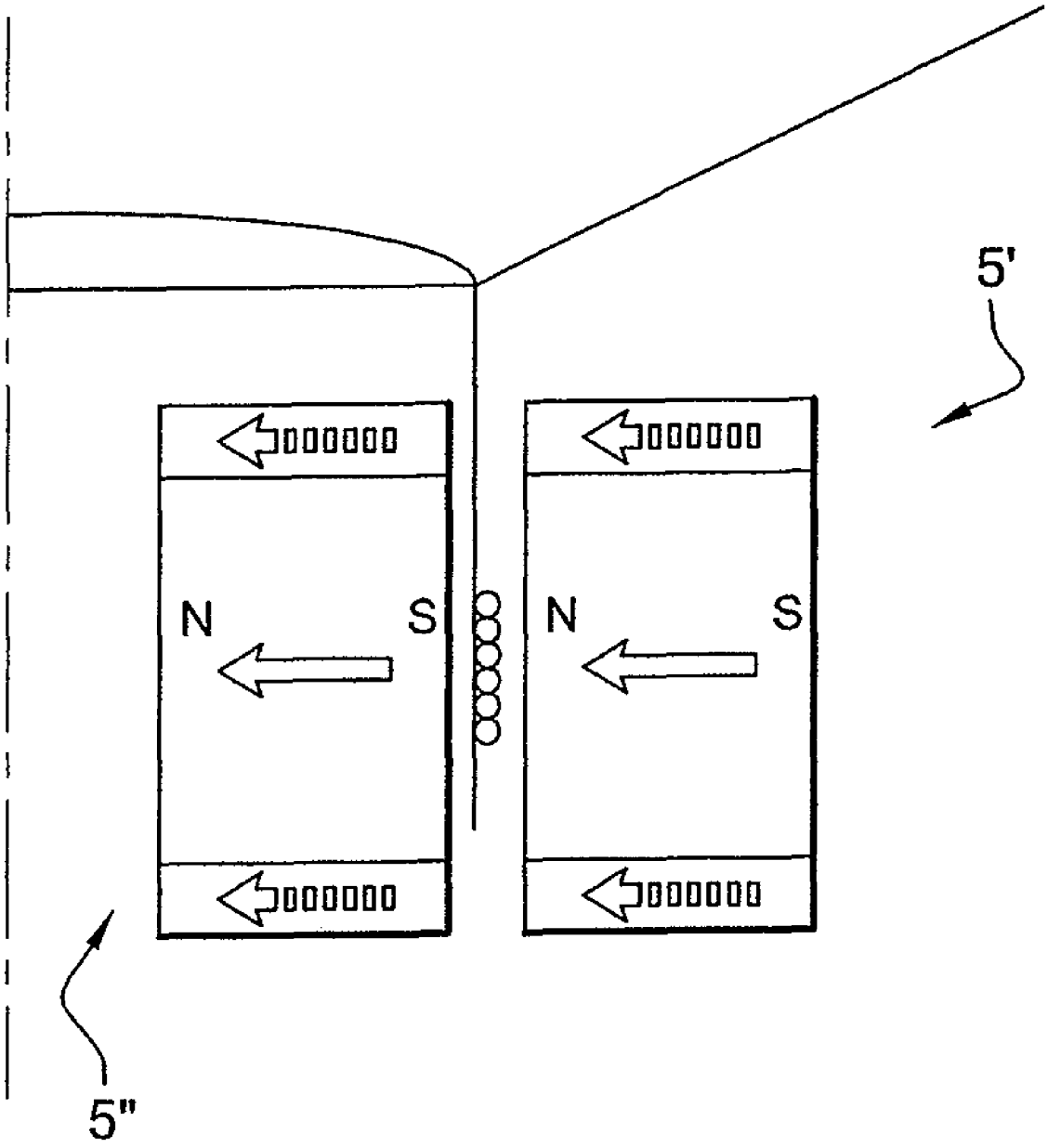

In a variant not shown in FIG. 1, magnetic structure 5 is internal relative to the mandrel, i.e. it is arranged toward the centre of the loudspeaker relative to the mandrel. In another variant, such as shown in FIG. 5, two magnetic structures that are identical (at least regarding to magnetic polarization and size of each magnet in the height direction) are implemented on each side of the mandrel. In the latter case, it is to be understood that, because the diameters are different between the internal and external magnetic structures, the proper magnetic fields generated can be different between the two structures. In an optimized variant, volumes of magnets are adjusted to make magnetic fields equal between the internal and external structures.

It is to be noted that, in a variant of FIG. 5, magnetic structures of the type 5' (FIG. 2) and 5" (FIG. 3) can be implemented according to any possible combination with a regular gap border (parallel straight edges).

Figure 2:
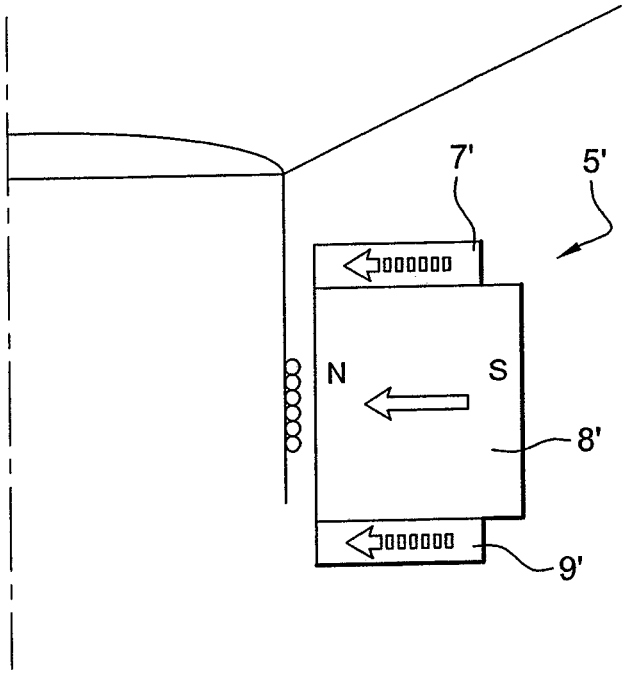
Figure 3:
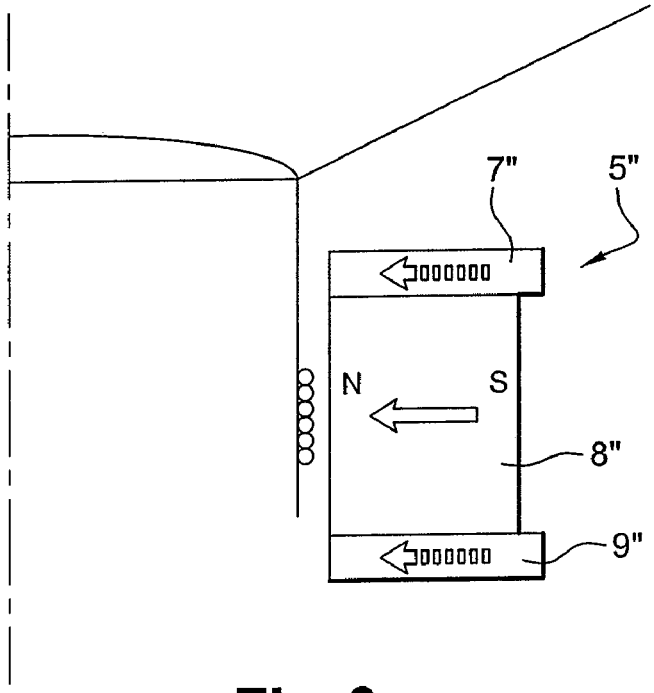

FIGS. 2 and 3 show variants in which top 7', 7" and bottom 9', 9" covering magnets have the same width, which is however smaller (FIG. 2) or larger (FIG. 3) than that of intermediate magnet 8', 8". In magnetic structures 5' and 5" of FIGS. 2 and 3, covering magnets 7', 7" and 9', 9" are arranged so that the gap-side pole faces thereof are on the same plane as those of intermediate magnet 8', 8". It is to be understood that this is valid for both an internal and an external magnetic structure (relative to coil-bearing mandrel) so that the gap border is straight.

By way of example of a structure of the type of that of FIG. 2, the intermediate magnet consists of N48 of 10 mm high and 12 mm wide, and covering magnets consist of N52 and are each 3 mm high and 10 mm wide. This configuration enables obtaining in a 2 mm-wide gap, at the coil-bearing mandrel (which is then approximately at 1 mm from the gap edge), a uniform magnetic field of 0.77 Tesla.

Figure 4:
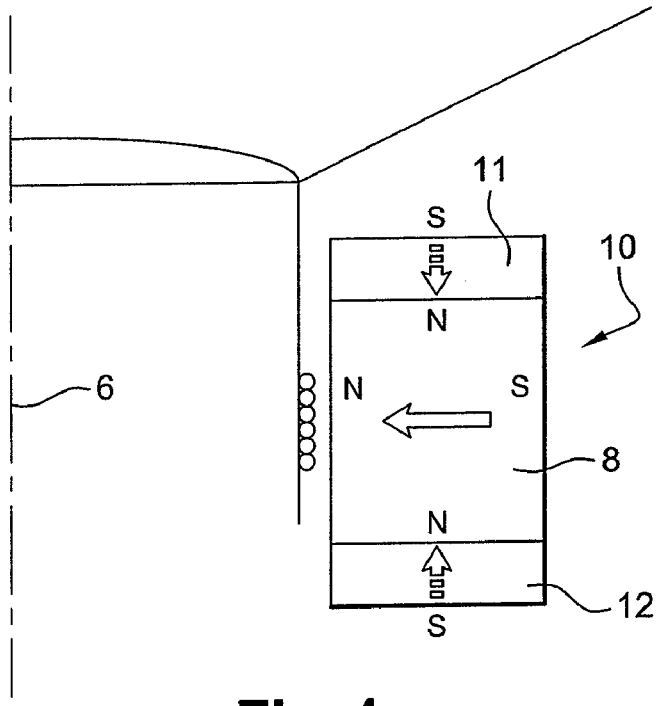

In magnetic structure 10 of FIG. 4, intermediate magnet 8 alone has a radial magnetic polarization (horizontal in the figure), and top 11 and bottom 12 covering magnets have axial magnetic polarizations (vertical in the figure and thus parallel to axis of symmetry 6 of the loudspeaker). Moreover, these magnetic polarizations of covering magnets 11, 12 are opposite to each other. Pole face signs of the three magnets are such that the generated magnetic field is preferably directed toward the gap. In the shown pole configuration, the generated magnetic field loops (loops back) on the gap side because the gap-side pole face of intermediate magnet 8 is of opposite sign relative to that of the free pole faces (top and bottom in the figure) of covering magnets 11 and 12. Unlike the previous exclusively radial configurations, remanent magnetization of intermediate magnet 8 is higher than remanent magnetization of each of covering magnets 11 or 12. A configuration according to FIG. 4 with intermediate magnet 8 of 1.4 Tesla and covering magnets 11, 12 of 1.1 Tesla each has been calculated; it generates a magnetic induction of 0.62 Tesla over 65% of the intermediate magnet height.

Another configuration according to FIG. 4 with intermediate magnet 8 of 1.1 Tesla (5 mm high and 16 mm wide) and covering magnets 11, 12 of 0.52 Tesla each (2 mm high and 16 mm wide each) has been calculated; it generates a sensibly uniform magnetic induction, this time over about 70% of the intermediate magnet height at 0.3 mm from the gap border.

It is important to note that a structure of the type of that of FIG. 4 (with crossed-polarization magnets) does not enable a substantially uniform magnetic induction to be obtained along the generating line bearing the coil in the gap over a height which at least equal to the intermediate magnet height, contrary to the other described structures (with parallel-polarization magnets).

Figure 6:
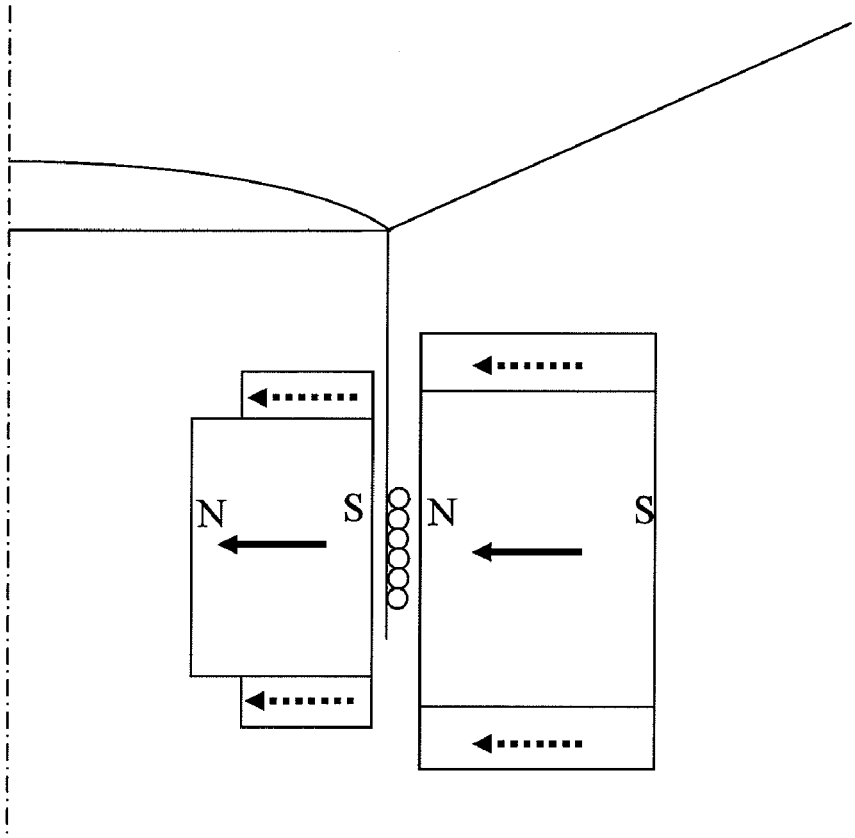
Figure 7:
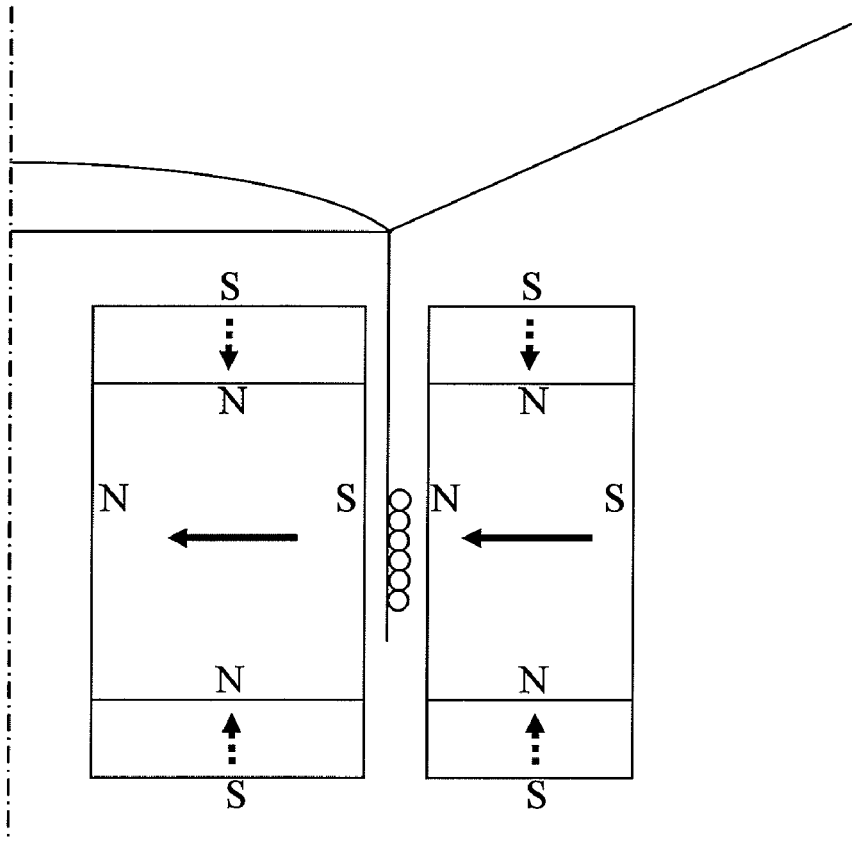

In embodiment variants, size and/or magnetization of the internal magnetic structure are independent of those of the external magnetic structure. Two embodiments of this type have been shown in FIGS. 6 and 7. Thus, it will be understood that all the combinations of size and/or magnetization differences between internal and external structures are encompassed in the scope of the invention. Preferably, with regard to the absence of rotational symmetry for magnetization, the whole arrangement of magnetic polarizations of internal and external magnetic structures remains identical, i.e. only radial in both internal and external structures (cf. FIGS. 5 and 6) or both with axial+radial combination (cf. FIG. 7).

All examples are given by way of information only and it will be understood that it is possible, without departing from the general scope of the invention, to invert the magnetic structures (external toward internal and/or symmetrically according to the cases), to split them (internal and external magnetic structure), to invert magnetic polarization orientations (North pole becomes South pole and conversely). Finally, it is to be noticed that, when considering essentially loudspeakers with a circular cylindrical symmetry, dome-shaped or cone-shaped, the diaphragm being circumscribed by circumferences, the invention may notably also apply to loudspeakers that are elliptical, or even square or substantially square in shape (with rounds corners).

The invention claimed is:

1. Magnetic structure (5, 5', 5", 10) generating a magnetic field for an ironless motor of an electrodynamic loudspeaker (1) having a mobile coil (2), wherein the magnetic structure generates a magnetic field in a gap in which the coil is arranged, said magnetic structure consisting of a stack of three magnets corresponding to one intermediate magnet (8, 8', 8") and two top and bottom covering magnets (7, 9) (7', 9') (7", 9") (11, 12), the gap-circumscribing edges of said magnets being aligned and forming a straight gap border, said magnets being further located side by side, the intermediate magnet having a radial magnetic polarization, the covering magnets having the same magnetic polarization and substantially identical remanent magnetizations, characterized in that the covering magnets have a radial (7, 9) (7', 9') (7", 9") or axial (11, 12) magnetic polarization and in that, when magnetic polarization of the covering magnets is radial, remanent magnetization of each covering magnet is higher than remanent magnetization of the intermediate magnet, and in that when magnetic polarization of the covering magnets is axial, remanent magnetization of each covering magnet is lower than remanent magnetization of the intermediate magnet.

2. The magnetic structure according to claim 1, characterized in that remanent magnetization of each covering magnet is higher or lower, according to the case, by 1% of remanent magnetization of the intermediate magnet, and preferably by 5%.

3. The magnetic structure according to claim 1, characterized in that remanent magnetization of each covering magnet is higher or lower, according to the case, by 10% of remanent magnetization of the intermediate magnet.

4. The magnetic structure according to claim 1, characterized in that, in a magnetic structure, the width of each covering magnet is larger than the width of the intermediate magnet.

5. The magnetic structure according to claim 1, characterized in that, in a magnetic structure, the width of each covering magnet is smaller than or equal to the width of the intermediate magnet.

6. The magnetic structure according to claim 1, characterized in that the three magnets have the same magnetic polarization, the polarization being radial, the same-sign pole faces of the three magnets lining the gap, remanent magnetization of each covering magnet being higher than remanent magnetization of the intermediate magnet.

7. The magnetic structure according to claim 1, characterized in that the intermediate magnet has a radial magnetic polarization and the two covering magnets have a magnetic polarization that is coaxial to the axis of symmetry of the loudspeaker, signs of the covering magnet pole faces in contact with the intermediate magnet being mutually identical and the same as the sign of the gap-lining pole face of the intermediate magnet, remanent magnetization of each covering magnet being lower than remanent magnetization of the intermediate magnet.

8. Motor for an electrodynamic loudspeaker, characterized in that it comprises a single magnetic structure (5, 5', 5", 10) according to claim 1, wherein said magnetic structure can be internal or external relative to the coil.

9. Motor for an electrodynamic loudspeaker comprising, opposite to each other and at the same level, two magnetic structures internal and external relative to the coil, characterized in that each of the structures is according to claim 1, magnetic polarizations of similar magnets being identical in both magnetic structures.

10. Loudspeaker comprising a motor according to claim 8.

11. The magnetic structure according to claim 2 characterized in that, in a magnetic structure, the width of each covering magnet is larger than the width of the intermediate magnet.

12. The magnetic structure according to claim 3 characterized in that, in a magnetic structure, the width of each covering magnet is larger than the width of the intermediate magnet.

13. The magnetic structure according to claim 2, characterized in that, in a magnetic structure, the width of each covering magnet is smaller than or equal to the width of the intermediate magnet.

14. The magnetic structure according to claim 3, characterized in that, in a magnetic structure, the width of each covering magnet is smaller than or equal to the width of the intermediate magnet.

15. The magnetic structure according to claim 2, characterized in that the three magnets have the same magnetic polarization, the polarization being radial, the same-sign pole faces of the three magnets lining the gap, remanent magnetization of each covering magnet being higher than remanent magnetization of the intermediate magnet.

16. The magnetic structure according to claim 2, characterized in that the intermediate magnet has a radial magnetic polarization and the two covering magnets have a magnetic polarization that is coaxial to the axis of symmetry of the loudspeaker, signs of the covering magnet pole faces in contact with the intermediate magnet being mutually identical and the same as the sign of the gap-lining pole face of the intermediate magnet, remanent magnetization of each covering magnet being lower than remanent magnetization of the intermediate magnet.

17. Motor for an electrodynamic loudspeaker, characterized in that it comprises a single magnetic structure (5, 5', 5", 10) according to claim 2, wherein said magnetic structure can be internal or external relative to the coil.

18. Motor for an electrodynamic loudspeaker comprising, opposite to each other and at the same level, two magnetic structures internal and external relative to the coil, characterized in that each of the structures is according to claim 2, magnetic polarizations of similar magnets being identical in both magnetic structures.

19. Loudspeaker comprising a motor according to claim 9.

* * * * *